US010626528B2

(12) United States Patent
Koiman

(10) Patent No.: US 10,626,528 B2
(45) Date of Patent: Apr. 21, 2020

(54) DOUBLE POINTED KNITTING RING

(71) Applicant: Daniela Koiman, Calabasas, CA (US)

(72) Inventor: Daniela Koiman, Calabasas, CA (US)

( * ) Notice: Subject to any disclaimer, the term of this patent is extended or adjusted under 35 U.S.C. 154(b) by 0 days.

(21) Appl. No.: 15/947,803

(22) Filed: Apr. 7, 2018

(65) Prior Publication Data

US 2018/0298531 A1 Oct. 18, 2018

Related U.S. Application Data

(60) Provisional application No. 62/485,976, filed on Apr. 16, 2017.

(51) Int. Cl.
*D04B 3/02* (2006.01)

(52) U.S. Cl.
CPC ..... *D04B 3/02* (2013.01)

(58) Field of Classification Search
CPC ..... D04B 3/00; D04B 3/02
USPC ..... 66/117
See application file for complete search history.

(56) References Cited

U.S. PATENT DOCUMENTS 1,269,014 A * 6/1918 Stansbery ..... D04B 3/00 66/118
1,966,690 A * 7/1934 Van Bergen ..... D04B 3/00 66/117
1,999,691 A * 4/1935 Ghaham ..... D04B 3/02 66/117
2,045,267 A * 6/1936 Graham ..... D04B 3/02 66/117
2,061,282 A * 11/1936 Leboff et al. ..... D04B 17/04 66/117
2,093,631 A * 9/1937 Burnham ..... D04B 3/02 66/117
2,094,262 A * 9/1937 Burnham ..... D04B 17/04 66/117
2,102,600 A * 12/1937 Miller ..... D04B 3/02 66/117
2,133,431 A 10/1938 Craft
2,183,791 A * 12/1939 Dunn ..... D04B 3/02 66/117
2,208,124 A * 7/1940 Dunn ..... D04B 3/02 66/117
2,230,495 A * 2/1941 Kohlmann ..... D04B 3/00 66/117
2,242,880 A * 5/1941 Dunn ..... D04B 3/02 66/117
2,462,473 A * 2/1949 Delaney ..... D04B 3/02 66/117
2,507,174 A * 5/1950 Phillips ..... D04B 3/00 66/118
2,633,720 A * 4/1953 Robbins ..... D04B 3/02 66/117
2,695,506 A * 11/1954 Kohlmann ..... D04B 3/02 66/117
3,097,474 A * 7/1963 Rohdenburg ..... D07B 1/185 57/23
3,280,595 A * 10/1966 Linstead ..... D04B 3/00 66/117

(Continued)

*Primary Examiner* — Danny Worrell
(74) *Attorney, Agent, or Firm* — Jonathan D Feuchtwang

(57) ABSTRACT

A double pointed knitting ring, including an open ring having first and second ends; a first knitting point attached to the first end; and a second knitting point attached to the second end; wherein the first and second knitting points are separated by a gap.

9 Claims, 6 Drawing Sheets

(56) References Cited

U.S. PATENT DOCUMENTS 3,438,223 A 4/1969 Linstead
4,007,610 A * 2/1977 Linstead ..... D04B 3/00 66/117
4,341,094 A * 7/1982 Heide ..... D04B 3/02 163/2
4,494,387 A * 1/1985 Phipps ..... D04B 3/02 66/117
4,553,410 A * 11/1985 Okada ..... D04B 3/02 66/117
4,646,543 A * 3/1987 Okada ..... D04B 3/02 66/117
4,680,947 A * 7/1987 Phipps, Sr. ..... D04B 3/02 66/117
4,693,094 A * 9/1987 Kahn ..... D04B 3/02 66/117
4,846,351 A * 7/1989 Gardiner ..... D04B 3/00 206/574
5,720,187 A * 2/1998 Matuo ..... D04B 3/02 66/117
6,983,627 B1 * 1/2006 Eley-Holden-Sotnik ..... D04B 3/02 66/117
7,117,693 B1 * 10/2006 Nova ..... D04B 3/02 66/117
7,954,342 B2 * 6/2011 Devagnanam ..... D04B 3/02 66/117
8,181,489 B2 * 5/2012 Selter ..... D04B 3/02 66/117
8,210,003 B2 * 7/2012 Zheng ..... D04B 3/02 66/117
8,464,559 B2 * 6/2013 West ..... D04B 3/02 66/117
8,499,586 B1 * 8/2013 Adam ..... D04B 33/00 66/118
9,181,641 B1 * 11/2015 Moraca ..... D04B 3/02

* cited by examiner

DOUBLE POINTED KNITTING RING

FIELD OF THE INVENTION

The invention relates to the field of hand-knitting tools and, more particularly, to knitting needles for hand-knitting items of small circumference.

BACKGROUND

It is very difficult to use traditional, straight knitting needles for hand knitting a small circumference ring for any item such as the top of a knitted hat, glove fingers, sock toes, the bottom of a knitted bag or other such items. An established Art of knitting circular items involves what is commonly known as "circular needles"—an assembly of two knitting needles connected by a flexible cord. The needles themselves are straight, not circular. The needle shafts may be affixed permanently to the cord or they may be removable to allow attachment to cords of different lengths. Circular needles are usually effective in knitting circles greater than 9 inches in diameter. When a circle is smaller than approximately 9 inches, the shafts of the needles are too long and rigid to knit the stitches on the opposing needle.

Some manufacturers of knitting needles make circular needles that have very short shafts and tips, but those are very difficult to handle because the shafts are too short to grip properly, especially by knitters of limited dexterity due to arthritis or other such conditions, and there is still a threshold of circumference below which even these short shafts cannot knit. To resolve this problem most knitters use multiple, double-pointed straight needles arranged in a square or a triangle configuration to handle such small circumference pieces. This arrangement, however, is very unstable and tends to come apart easily. Extensive practice and dexterity are required to use this method of knitting. The method of using multiple double pointed needles to knit small circumference items is disposed to dropping stitches between the needles and to stretching out the stitches beyond their intended size, creating an undesirable effect commonly known as "laddering".

Some knitters use a method commonly called the "magic loop" in which a long circular needle—an arrangement of two knitting needles connected by a flexible cord at least 30 inches in length—is used to manipulate the stitches in the small circumference piece of knitting. This technique also requires significant practice and dexterity to use and can stretch the knitted stitches beyond their intended size. As a result, many hand knitters never attempt to knit items that require knitting small-circumference rounds.

SUMMARY OF THE INVENTION

Disclosed is a double-pointed knitting ring, comprising: an open ring having first and second ends; a first knitting point attached to the first end; and a second knitting point attached to the second end; wherein the first and second knitting points are separated by a gap.

According to one aspect of the invention, at least one of the first and second knitting points is removably attached to the open ring. The at least one of the first and second knitting points may be removably attached to the open ring by screw threads or magnets. The first knitting point may be parallel to the second knitting point, or the first knitting point may face the second knitting point.

The open ring is may have a shape selected from the group (U-shaped, oval-shaped, or tear-shaped).

One of the first and second knitting points in the aforementioned embodiment may be replaced by a knitting needle assembly comprising a cord having an elongate needle at one end of the cord and a fitting attached to an opposing end of the cord, the fitting replacing the one of the first and second knitting points.

Also disclosed is a hybrid double-pointed knitting ring, comprising: an open ring having first and second ends; a first knitting point attached to the first end of the open ring; and a knitting needle assembly comprising a cord having an elongate needle at one end of the cord and a fitting attached to an opposing end of the cord, the fitting attached to the second end of the open ring; wherein the first knitting point and the elongate needle are separated by a gap.

A knitting ring kit, comprising: the double-pointed knitting ring of claim 1; and a knitting needle assembly comprising a cord having a needle at one end and a fitting attached to an opposing end of the cord; wherein the needle assembly is configured to replace one of the first and second knitting points.

DETAILED DESCRIPTION

Figure 1:
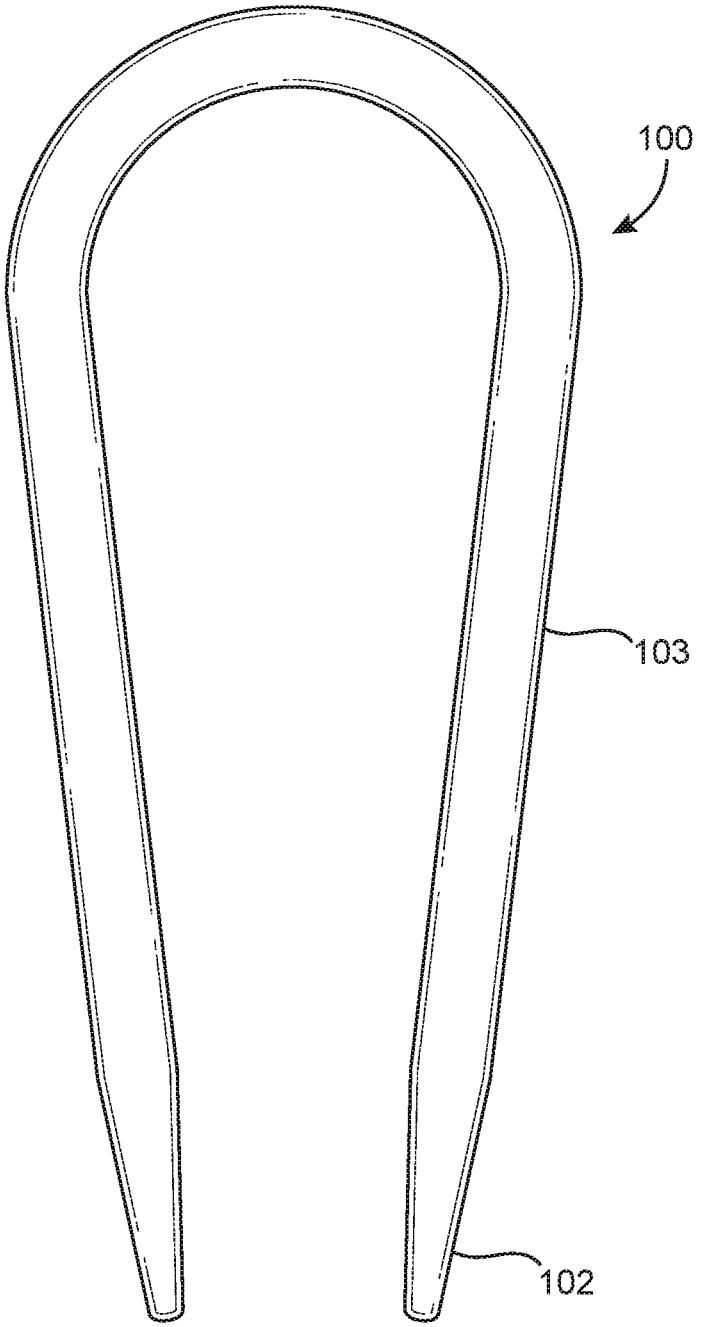
FIG. 1 illustrates a knitting circle with two fixed kitting points.

The present invention relates to a tool hereinafter termed a knitting ring for use in hand-knitting round objects of a small circumference. FIG. 1 depicts knitting ring 100 comprising a somewhat U-shaped body 103 and two fixed knitting point 102 separated by a small gap 104. Body 103 and knitting points 102 are formed of a rigid material with a smooth, non-porous finish that will allow yarn to slide easily around the ring and prevent snagging.

The knitting points 102 may be parallel to one another or pointing at each other at any angle.

The knitter will use a conventional straight needle in conjunction with one of the knitting points 102 to knit a stitch on the left side of the knitting ring 100 and then transfer the knitted stitch across the gap to the right side of the knitting ring 100.

Knitters who hold the working yarn in their left hand while knitting may optionally place a small, thin ring of a flexible material such as rubber or a similar synthetic material on the right-side shaft of the knitting ring 100, just below the knitting point 102, in order to prevent stitches from being pulled off the ring during the knitting process.

The double-pointed open ring 100 of the present invention provides the stability that the prior art lacks, thereby allowing knitters of varying abilities and levels of dexterity to knit small-circumference objects and allows for knitting small rounds in a uniform manner without stretching the stitches.

Figure 2:
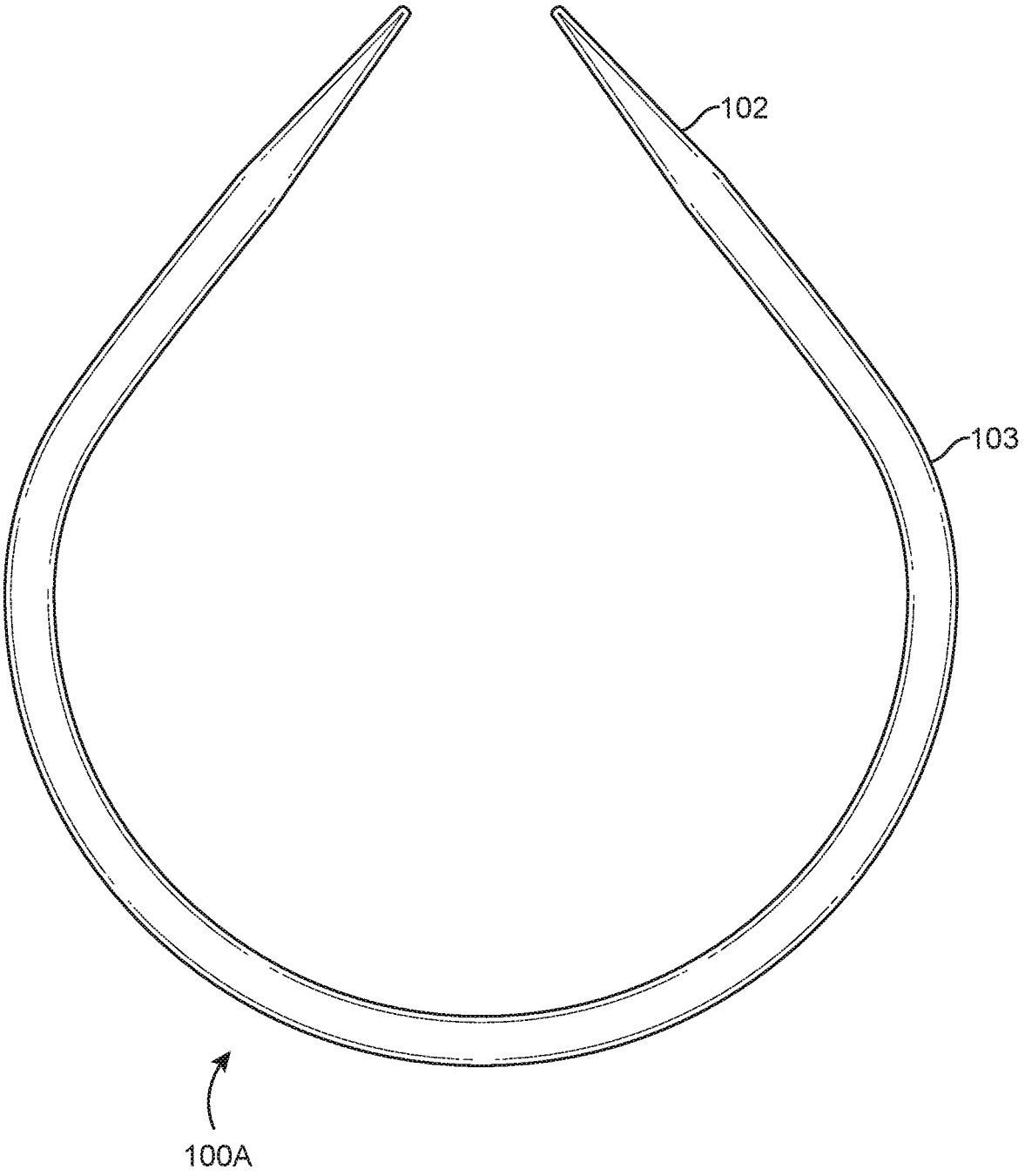
FIG. 2 illustrates a knitting circle having a slightly different shape than the one shown in FIG. 1.

FIG. 2 shows knitting ring 100A having two fixed knitting points 102. Body 103 in knitting ring 100A has a slightly different shape than body 103 in knitting ring 100 and the knitting points 102 are angled toward one another but is otherwise identical in use and construction.

Figure 6:
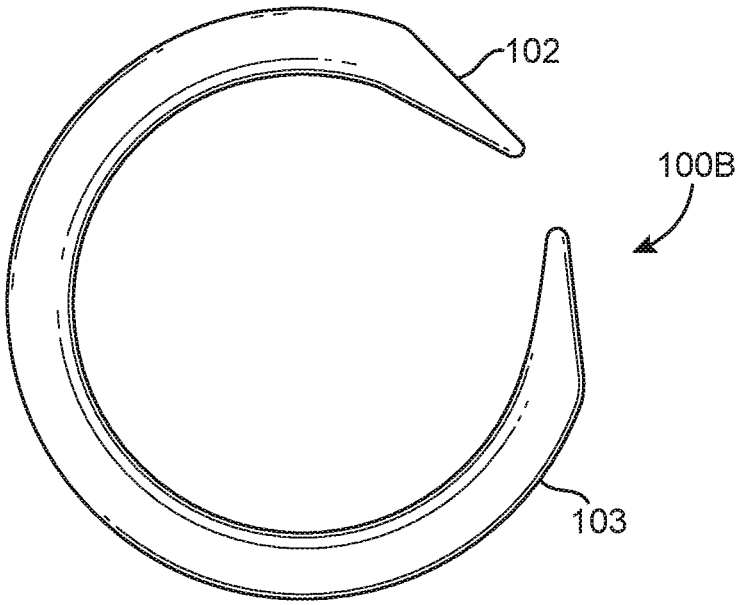
FIG. 6 illustrates a knitting circle with two fixed knitting points having a slightly different shape than the one shown in FIG. 1.

FIG. 6 shows knitting ring 100B having two fixed knitting points 102. Body 103 in knitting ring 102B has a slightly different shape than body 103 in knitting ring 100 and 100A but is otherwise identical.

Figure 3:
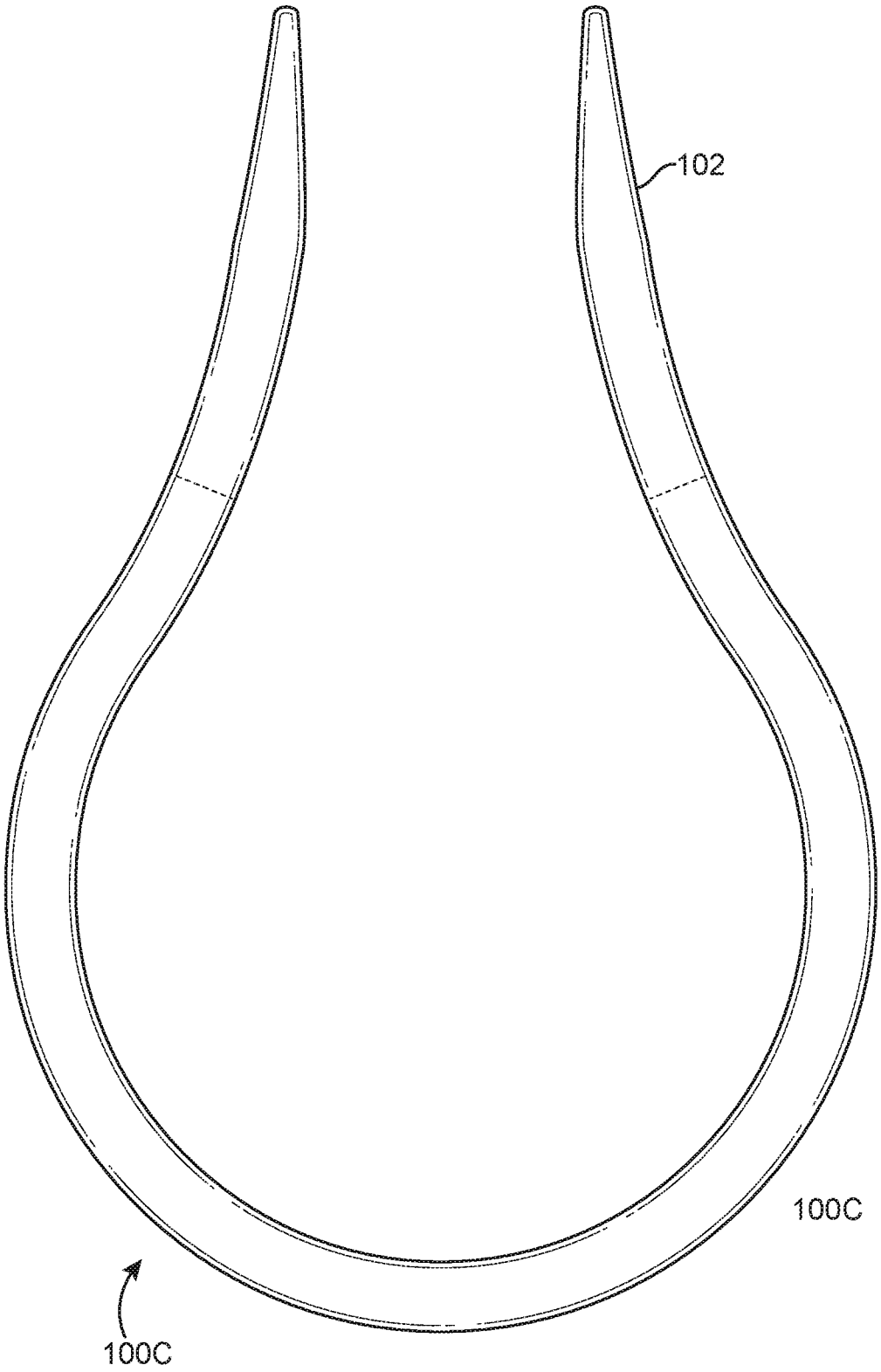
FIG. 3 illustrates a knitting circle having two knitting points, at least one of which is removable.
Figure 7:
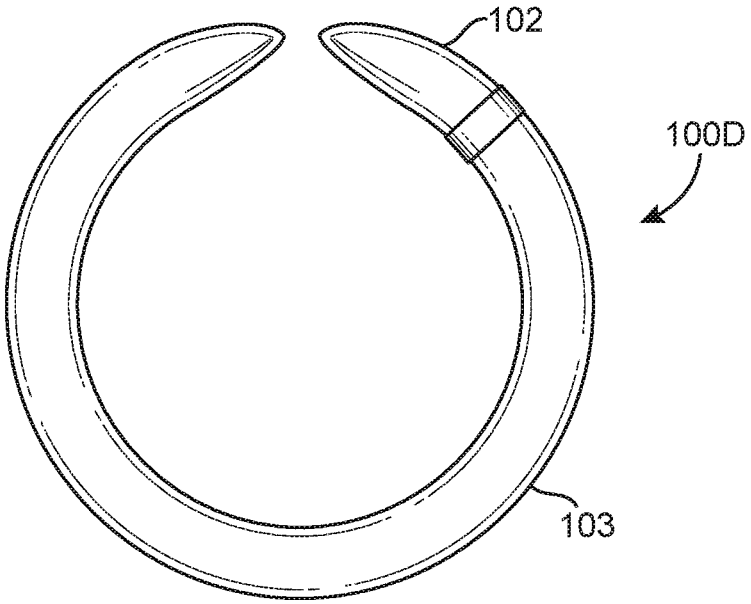
FIG. 7 illustrates a knitting circle having two knitting points, one of which is removable.

FIG. 3 depicts a knitting ring 100C which is similar to knitting rings 100, 100A. The only difference between knitting ring 100 and knitting ring 100C is that one or both of the knitting points 102 are removable. FIG. 7 depicts knitting ring 100D which is a slight variation on ring 100C in which only one of the knitting point 102 is removable.

Figure 4:
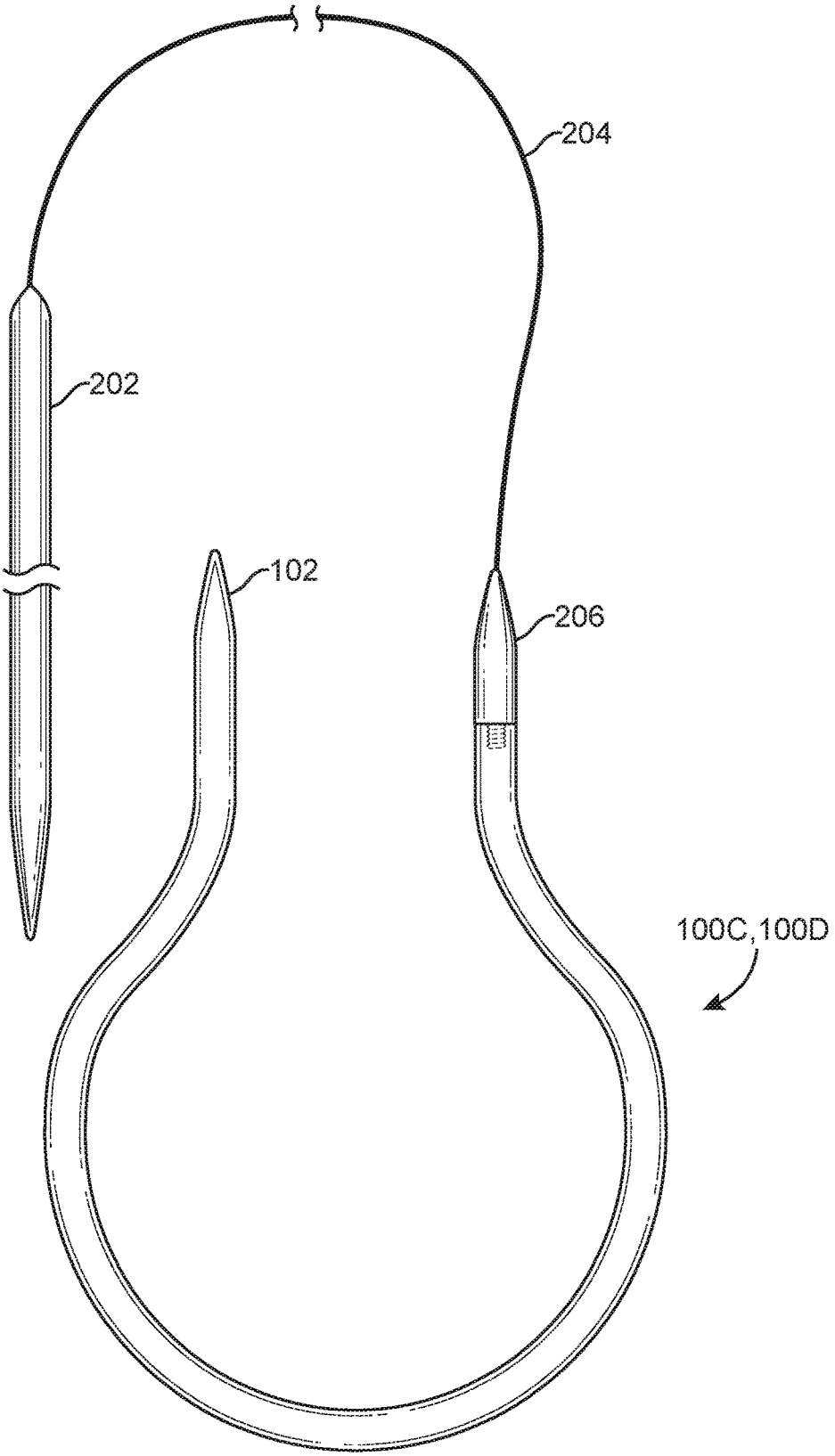
FIG. 4 illustrates the knitting circle of FIG. 1 with the removable knitting point replaced with a knitting needle attached to a cord.
Figure 5:
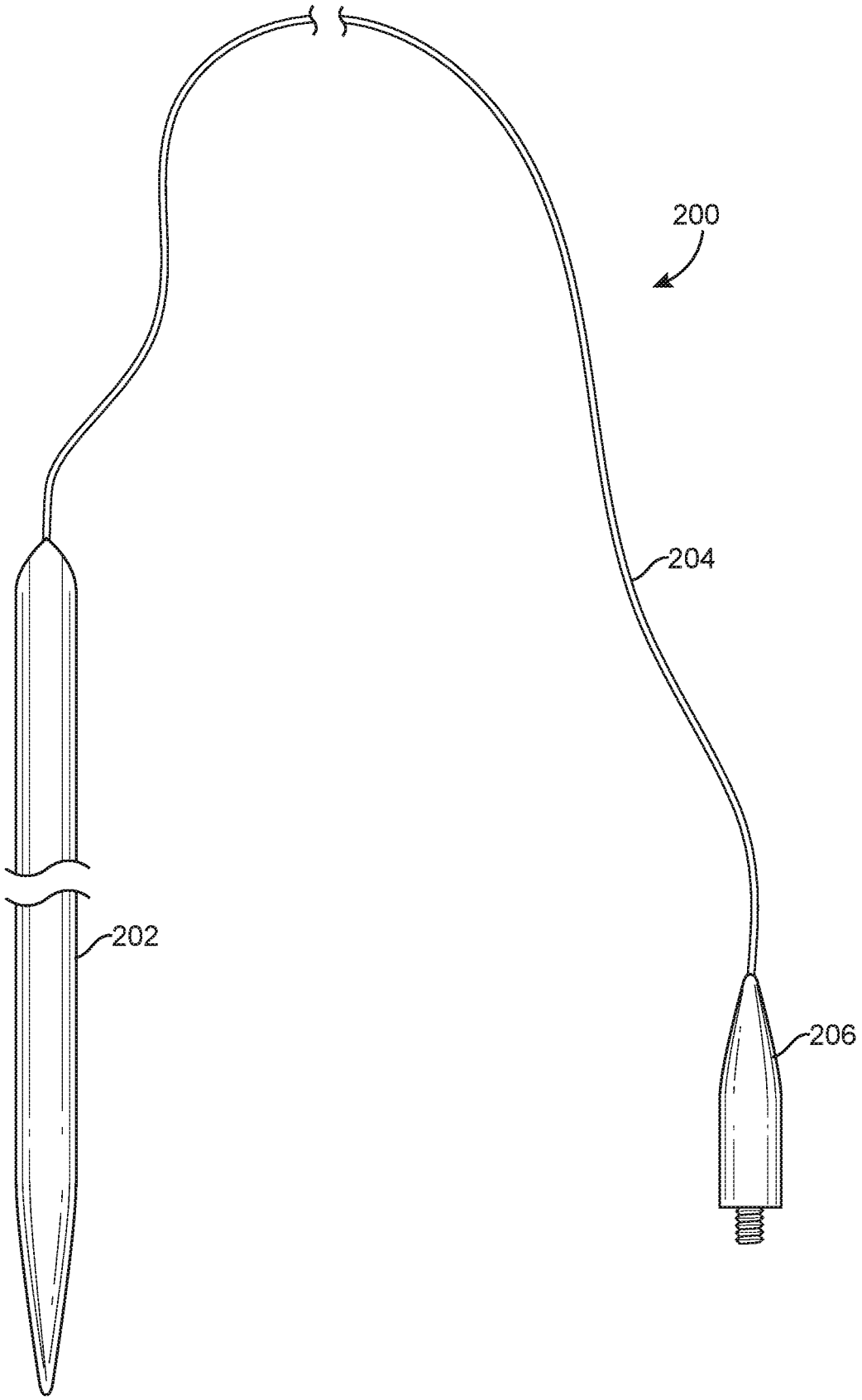
FIG. 5 illustrates a knitting needle on a cord.

The knitting point 102 may be removed and replaced with a needle assembly 200 (FIG. 5). FIG. 4 depicts knitting ring 100C (or 100D) with one of the knitting point 102 replaced with needle assembly 200.

In FIGS. 3 and 6, knitting point 102 may be attached to the body 103 using conventional means such as screw threads, magnets or the like. Needle assembly 200 includes a knitting needle 202 attached to a cord 204 and a fitting 206. Fitting 206 is attached to the body 103 uses the same conventional means used to attach the knitting point 102. In use, the knitter simply replaces one of the knitting points 102 with needle assemble 200.

In FIG. 4, the knitting needle 202 would be operated to perform the knitting in the way it is usually performed, with the knitter periodically pulling the cord 204 outward to slide the knitted stitches back onto the knitting ring 100. In essence, the knitting ring 100 of the present invention replaces the left-side needle of a conventional circular needle apparatus. The present invention allows a knitter to knit continuously in very small circles without having to manipulate cumbersome, unstable needle arrangements or learn complex and confusing techniques.

The knitter will transfer yarn stitches previously knitted on straight or circular needles onto the double-pointed knitting ring 100 once the circumference of the knitted item becomes too small to continue knitting on the previous set of knitting needles.

The knitter will continue to knit the item using a straight needle or the cord-attached circular needle to knit a stitch on the left side of the double pointed knitting ring and transfer the knitted stitch to the right side of the ring 100. The knitter will continue to knit the item in a circular fashion as needed. The gap between the knitting points 102 will allow the knitter to move the yarn back and forth between the front and the back of the double pointed knitting ring 100 as required for knitting.

The knitting ring 100 is not limited to any specific size or material. One of ordinary skill in the art will appreciate that variations in size, thickness and materials can be made without departing from the true spirit and scope of the invention. These variations can be made without departing from the essential teaching of the invention and would be done in order to accommodate different thicknesses of yarn and varying stitch sizes.

I claim:

1. A double-pointed knitting ring, comprising:

an open ring body having first and second ends;

a first knitting point attached to the first end, wherein the first knitting point and a portion of the curved ring cooperatively form a first curved knitting needle; and a second straight knitting needle assembly comprising a cord having straight needle at one end of the cord and a fitting attached to an opposing end of the cord, the fitting attached to the second end of the open ring body.

2. The double-pointed knitting ring of claim 1, wherein at least one of the first curved knitting needle and the second straight knitting needle assembly is removably attached to the open ring body.

3. The double-pointed knitting ring of claim 2, wherein the at least one of the first curved knitting needle and the second straight knitting needle assembly is removably attached to the open ring body by screw threads.

4. The double-pointed knitting ring of claim 2, wherein the at least one of the first curved knitting needle and second straight knitting needle assembly is removably attached to the open ring body by magnets.

5. The double-pointed knitting ring of claim 1, where the open ring is generally U-shaped.

6. The double-pointed knitting ring of claim 1, where the open ring is generally oval-shaped.

7. The double-pointed knitting ring of claim 1, where the open ring is generally tear-shaped.

8. The double-pointed knitting ring of claim 1, wherein the open ring body is formed of a rigid material.

9. A double-pointed knitting ring, comprising:

a curved knitting needle having first and second ends, a first knitting point attached to the first end;

a straight knitting needle having third and fourth ends, a second knitting point attached to the third end; and a cord having fifth and sixth ends, the fifth end of the cord operatively connected to the second end of the curved needle, the sixth end of the cord operatively attached to the third end of the straight needle.

* * * * *